United States Patent [19]

Ishihara et al.

[11] 3,978,275

[45] Aug. 31, 1976

[54] TELECOMMUNICATION CABLE AND METHOD AND APPARATUS FOR MANUFACTURING THE SAME

[75] Inventors: Koshi Ishihara; Akira Sakamoto, both of Mito, Japan

[73] Assignee: Nippon Telegraph and Telephone Public Corporation, Tokyo, Japan

[22] Filed: Jan. 29, 1975

[21] Appl. No.: 544,956

[30] Foreign Application Priority Data

| | | |
|---|---|---|
| Feb. 8, 1974 | Japan | 49-16105 |
| Mar. 25, 1974 | Japan | 49-33284 |

[52] U.S. Cl. ..... 174/34; 174/113 R

[51] Int. Cl.[2] ..... H01B 11/02

[58] Field of Search ..... 174/27, 34, 113 R, 35

[56] References Cited

UNITED STATES PATENTS

| | | | |
|---|---|---|---|
| 3,099,703 | 7/1963 | Martin | 174/34 |
| 3,382,314 | 5/1968 | Nordblad | 174/34 |
| 3,546,357 | 12/1970 | MacPherson et al. | 174/34 |
| 3,821,465 | 6/1974 | Karlstedt | 174/34 |

*Primary Examiner*—Arthur T. Grimley
*Attorney, Agent, or Firm*—Flynn & Frishauf

[57] ABSTRACT

A telecommunication cable comprises a plurality of conductor units bundled together, each conductor unit occupying a prescribed position in the cross-section of the cable and each conductor unit including at least four conductor pairs. The cable includes a plurality of lengthwise adjacent continuously connected sections, the conductor pairs of the conductor units being systematically interchanged in position relative to other conductor pairs of its respective conductor unit at each of said adjacent sections, and the conductor pairs being further systematically interchanged between conductor units at selected ones of the adjacent sections, so that both the grouping of the conductor pairs and the positions of the conductor units are systematically interchanged along the length of the cable. This systematic interchanging decreases the length over which any two conductor pairs are immediately adjacent each other and thereby reduces the cross-talk among the conductor pairs of the cable. Preferably, a given conductor pair of a conductor unit is taken as the base and the other conductor pairs are wound therearound.

6 Claims, 39 Drawing Figures

FIG. 1
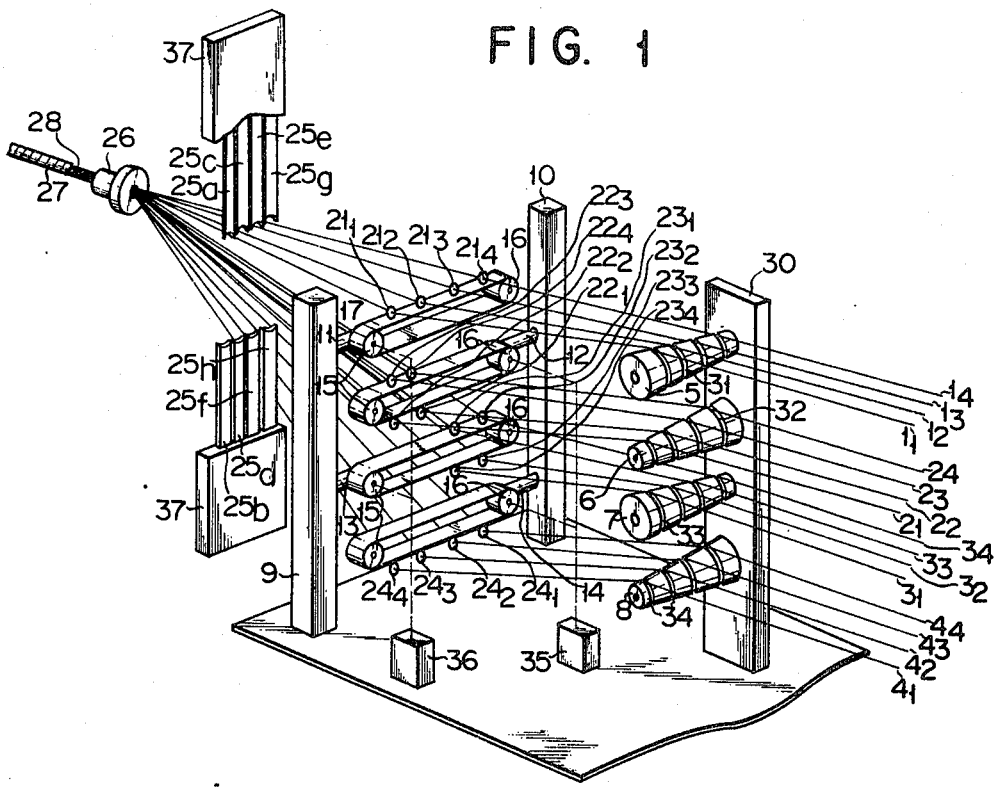
FIG. 2-(1)
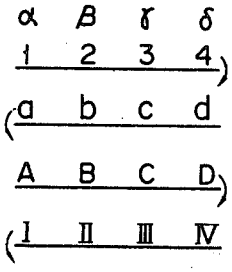
FIG. 2-(2)
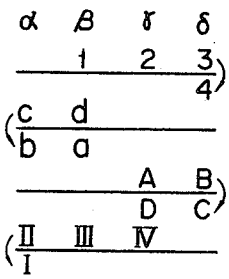
FIG. 2-(3)
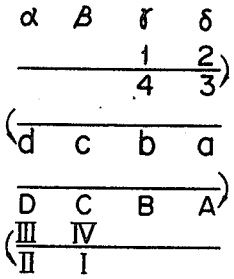
FIG. 2-(4)
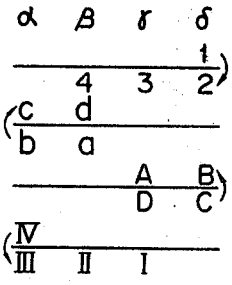
FIG. 2-(5)
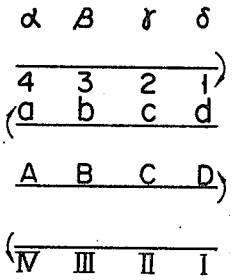

FIG. 5-(1)
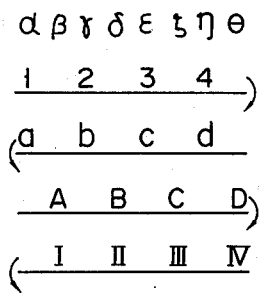
FIG. 5-(2)
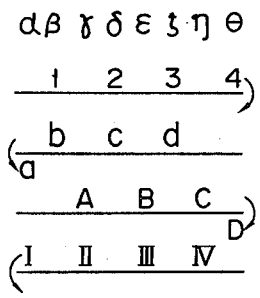
FIG. 5-(3)
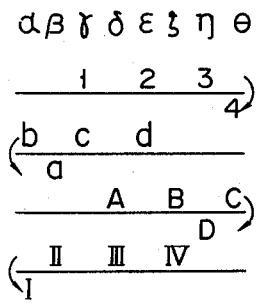
FIG. 5-(4)
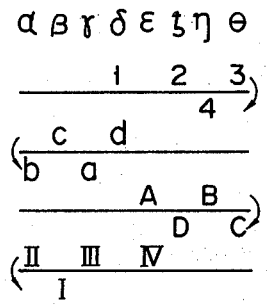
FIG. 5-(5)
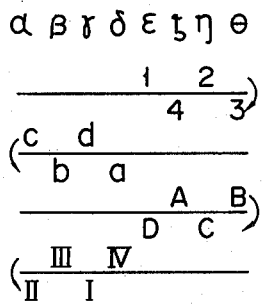
FIG. 5-(6)
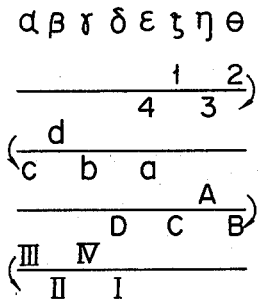
FIG. 5-(7)
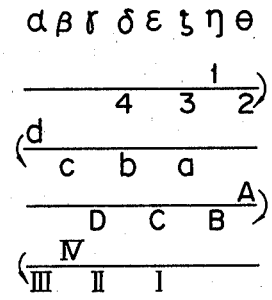
FIG. 5-(8)
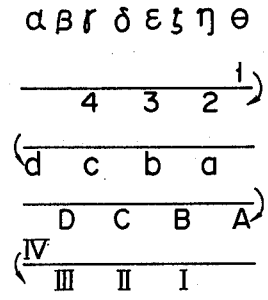
FIG. 5-(9)
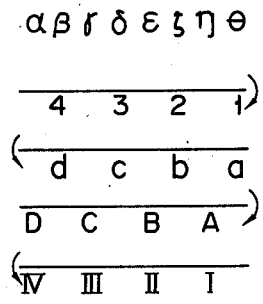

FIG. 7-(1)
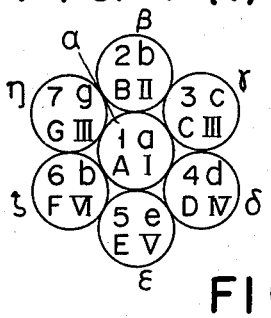
FIG. 7-(2)
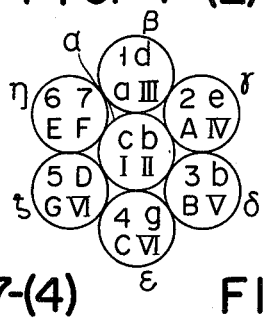
FIG. 7-(3)
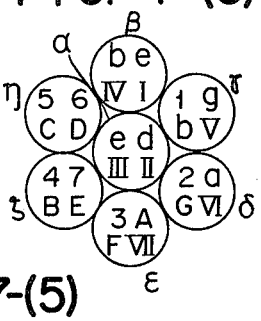
FIG. 7-(4)
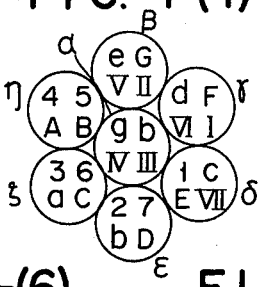
FIG. 7-(5)
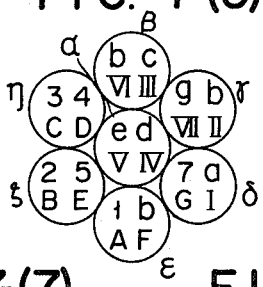
FIG. 7-(6)
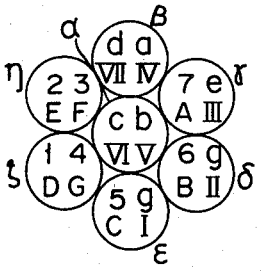
FIG. 7-(7)
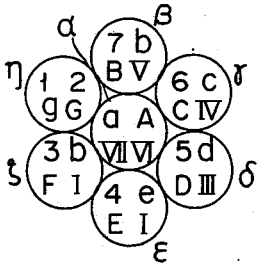
FIG. 7-(8)
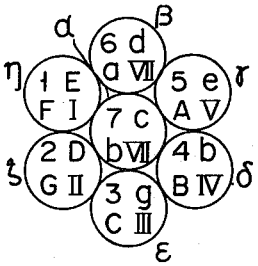
FIG. 8
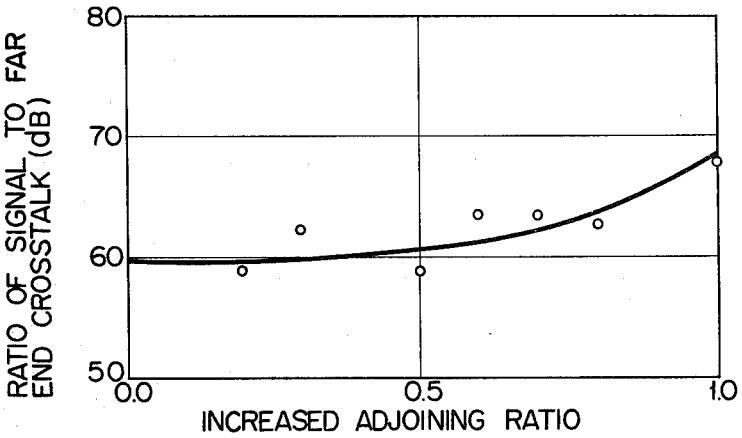

FIG. 10

| | ℓ-(1) | ℓ-(2) | ℓ-(3) | ℓ-(4) | ℓ-(5) |
|---|---|---|---|---|---|
| α | $a_1$<br>$a_5$ $a_2$<br>$a_4$ $a_3$ | $a_1$<br>$e_1$ $b_1$<br>$d_1$ $c_1$ | $a_1$<br>$e_4$ $b_2$<br>$d_3$ $c_5$ | $a_1$<br>$e_2$ $b_3$<br>$d_5$ $c_4$ | $a_1$<br>$e_5$ $b_4$<br>$d_2$ $c_3$ |
| β | $b_1$<br>$b_5$ $b_2$<br>$b_4$ $b_3$ | $a_2$<br>$e_2$ $b_2$<br>$d_2$ $c_2$ | $a_2$<br>$e_5$ $b_3$<br>$d_4$ $c_1$ | $a_2$<br>$e_3$ $b_4$<br>$d_1$ $c_5$ | $a_2$<br>$e_1$ $b_5$<br>$d_3$ $c_4$ |
| γ | $c_1$<br>$c_5$ $c_2$<br>$c_4$ $c_3$ | $a_3$<br>$e_3$ $b_3$<br>$d_3$ $c_3$ | $a_3$<br>$e_1$ $b_4$<br>$d_5$ $c_2$ | $a_3$<br>$e_4$ $b_5$<br>$d_2$ $c_1$ | $a_3$<br>$e_2$ $b_1$<br>$d_4$ $c_5$ |
| δ | $d_1$<br>$d_5$ $d_2$<br>$d_4$ $d_3$ | $a_4$<br>$e_4$ $b_4$<br>$d_4$ $c_4$ | $a_4$<br>$e_2$ $b_3$<br>$d_1$ $c_5$ | $a_4$<br>$e_5$ $b_1$<br>$d_3$ $c_2$ | $a_4$<br>$e_3$ $b_2$<br>$d_5$ $c_1$ |
| ε | $e_1$<br>$e_5$ $e_2$<br>$e_4$ $e_3$ | $a_5$<br>$e_5$ $b_5$<br>$d_5$ $c_5$ | $a_5$<br>$e_3$ $b_1$<br>$d_2$ $c_4$ | $a_5$<br>$e_1$ $b_2$<br>$d_4$ $c_3$ | $a_5$<br>$e_4$ $b_3$<br>$d_1$ $c_2$ |

FIG. 15

| | ℓ1 | ℓ2 | ℓ3 | ℓ4 |
|---|---|---|---|---|
| α | a b<br>c d | a 1<br>A I | a 4<br>B III | a 3<br>D II |
| β | 1 2<br>3 4 | b 2<br>B II | b 1<br>C IV | b 4<br>A III |
| γ | A B<br>C D | c 3<br>C III | c 2<br>D I | c 1<br>B IV |
| δ | I II<br>III IV | d 4<br>D IV | d 3<br>A II | d 2<br>C I |

TELECOMMUNICATION CABLE AND METHOD AND APPARATUS FOR MANUFACTURING THE SAME

This invention relates to a telecommunication cable, and a method and apparatus for manufacturing the same which are designed to equalize the electric properties of the respective conductor pairs (either coaxial pairs or wire pairs) constituting each conductor unit and improve the crosstalk characteristics thereof.

With the prior art telecommunication cable, the core wires, if provided in a small number, were twisted together along the full length of the cable. Where the cable consisted of a large number of core wires, said core wires were formed into a plurality of pairs. A prescribed number of such pairs were grouped together to form a conductor unit. Further, a plurality of such conductor units were bundled together all along the entire cable. Thus the prior art cable had the drawbacks that the relative positions occupied by the respective conductor pairs in a conductor unit remained unchanged throughout the cable, with the result that cross-talk occurring between the adjacent conductor pairs imposed a limitation on the maximum effective length of a telecommunication cable; that where an inner core wire and an outer core wire bundled together to form a conductor pair had different lengths, then these inner and outer core wires presented unequal electrical properties such as D.C. resistance, capacity and loss; and that where a telecommunication system consisted of such cable, the above-mentioned different electric properties should be taken into consideration in order to attain the proper function of said telecommunication system.

It is accordingly the object of this invention to provide a telecommunication cable and a method and apparatus for manufacturing the same which cause the relative positions occupied by the conductor pairs included in the conductor units constituting the cable to be interchanged from one prescribed lengthwise section of the cable to another so as to more decrease the "adjoining ratio" of the conductor pairs of the respective conductor units than in the prior art cable, with said position-interchanging process repeated one major division after another throughout the entire cable, thereby attained the unification of the electric properties of the constituent conductor pairs and the improvement of crosstalk characteristics of the cable as a whole.

SUMMARY OF THE INVENTION

To this end, a telecommunication cable according to this invention is constructed by grouping at least four conductor pairs into a conductor unit, further bundling together a plurality of said conductor units and arranging these bundled conductor units such that the relative positions occupied by the conductor pairs constituting all the conductor units are interchanged from one prescribed lengthwise section of the cable to another so as to decrease the "adjoining ratio" of said conductor pairs, with said position-interchanging process repeated one major division after another throughout the entire cable.

The method of manufacturing a telecommunication cable according to this invention comprises the steps of pulling cable-forming conductor pairs through wire guides mounted in the same number as at least four conductor pairs constituting a conductor unit on reciprocative parallel disposed endless belts provided for each conductor unit, controlling the shifting of said endless belts to cause the relative positions of the respective conductor pairs constituting all the conductor units to be interchanged from one prescribed lengthwise section of the cable to another in order to attain the unification of electric properties of said conductor pairs and improve the cross-talk characteristics of the cable as a whole; setting the conductor pairs of each conducor unit guided through the wire guides for interchange of the relative positions at the prescribed sites in the cross sectional area of the cable; and finally passing the conductor pairs thus located jointly through a converging or bundling die to construct a cable.

An apparatus for manufacturing a telecommunication cable according to an embodiment of this invention comprises reciprocative parallel disposed endless belts provided for each conductor unit comprising of at least four conductor pairs and fitted with the same number of wire guides as said conductor pairs; vertical position-setting devices for determining the vertical positions of any desired ones of the conductor pairs of each conductor unit which have been drawn through the corresponding dies; horizontal position-setting devices for determining the horizontal positions of any desired ones of the conductor pairs of each conductor unit which have been passed through the corresponding dies; and a bundling die for converging the conductor pairs of each conductor unit whose vertical as well as horizontal positions have thus been fixed for interchange, each time the aforesaid vertical position and horizontal position-setting devices are operated.

It has been experimentally proved that the application of a method and apparatus for manufacturing a telecommunication cable according to this invention caused the relative positions of the conductor pairs of all the conductor units constituting the cable to be so interchanged from one prescribed lengthwise section of the cable to another so as to decrease the "adjoining ratio" of said conductor pairs, thereby attaining the unification of the electric properties of all the conductor pairs included in the cable and the improvement of crosstalk characteristics of the cable as a whole.

BRIEF DESCRIPTION OF THE DRAWING

FIG. 1 schematically illustrates the construction of an embodiment of the apparatus for manufacturing a telecommunication cable according to this invention;

FIGS. 2-(1) to 2-(5) show the sequential steps by which 16 conductor pairs included in the same number in, for example, four conductor units constituting a telecommunication cable have their relative positions interchanged from one prescribed lengthwise section of the cable to another according to an embodiment of the invention;

FIGS. 5-(1) to 5-(9) present the sequential steps by which the 16 conductor pairs constituting a telecommunication cable have their relative positions interchanged for each conductor unit from one prescribed lengthwise section of the cable to another according to another embodiment of the invention;

FIGS. 7-(1) to 7-(8) set forth the sequential steps by which the 28 conductor pairs included in the summer number in seven conductor units constituting a telecommunication cable have their relative positions interchanged for each conductor unit from one prescribed lengthwise section of the cable to another according to another embodiment of the invention;

FIG. 8 indicates the actually measured relationship between the undesirably increased "adjoining ratio" of conductor pairs and the ratio of signal to far end crosstalk;

FIG. 10 presents a pattern in which the relative positions of the 25 conductor pairs included in the same number in the five conductor units constituting a telecommunication cable shown in FIG. 9 are interchanged for each conductor unit from one prescribed lengthwise section of the cable to another ($l$-(1) to $l$-(5));

FIG. 15 shows the arrangement of the conductor pairs of each conductor unit after their relative positions are interchanged through the respective prescribed lengthwise sections $l_2$ to $l_4$ of a telecommunication cable.

DETAILED DESCRIPTION

Figure 3:
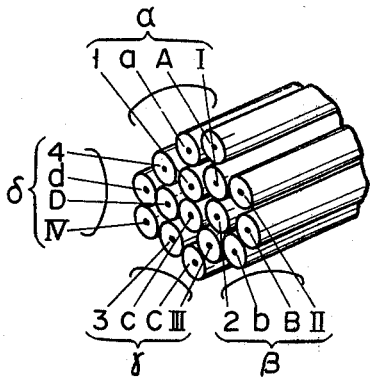
FIG. 3 is a fractional oblique view of bundled 16 conductor pairs constituting the cable whose relative positions have been defined for each conductor unit.
Figure 4:
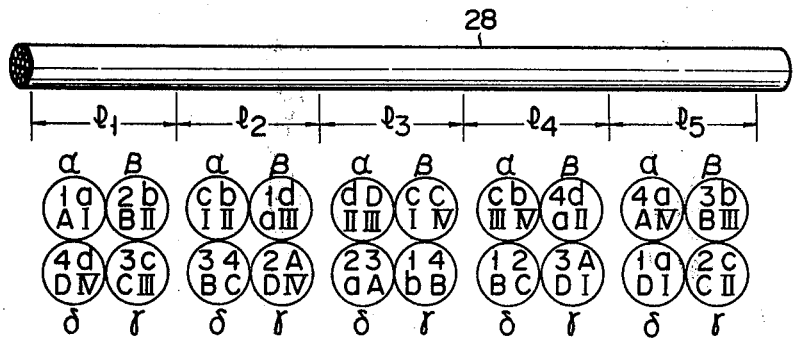
FIG. 4 indicates the arrangement of the 16 conductor pairs included in the same number in, for example, four conductor units constituting a telecommunication cable whose relative positions have been interchanged for each conductor unit from one prescribed lengthwise section of the cable to another according to an embodiment of the invention.

A telecommunication cable according to this invention is constructed by an apparatus schematically shown in, for example, FIG. 1. Referring to FIG. 1, four tapered pulleys 5, 6, 7, 8 are fitted to an upright support board 30 in a horizontal direction at a substantially equal vertical interval. Each tapered pulley is provided with guide grooves 31, 32, 33, 34 for guiding the conductor pairs. These guide grooves have the same number as the conductor pairs included in each of the conductor units constituting the telecommunication cable. As used herein, the term "conductor pair" is defined to mean a conductor pair used with, for example, a coaxial cable. This embodiment relates to a telecommunication cable comprising four conductor units, each of which is formed of four conductor pairs, namely containing 16 conductor pairs in all. These conductor pairs $1_1$ to $1_4$, $2_1$ to $2_4$, $3_1$ to $3_4$ and $4_1$ to $4_4$, pass over the four tapered pulleys 5, 6, 7, 8 by being guided through the grooves 31, 32, 33, 34 of each said pulley. Support poles 9, 10 are erected on both sides and at an intermediate point of the passageway of the 16 conductor pairs defined between said tapered pulleys 5, 6, 7, 8 and two groups of upright parallel disposed arms **25*a*-25*c*-25*e*-25*g* and 25*b*-25*d*-25*f*-25*h* which are positioned above and below said passaeway so as to vertically move the desired ones of said 16 conductor pairs. Support rods 11, 13 are horizontally fitted to one support pole 9, and support rods 12, 14 are also horizontally fitted to the other support pole 10. These supports rods 11, 12, 13, 14 are set at positions horizontally corresponding to the taperd pulleys 5, 6, 7, 8, with a substantially equal vertical interval allowed between said support rods 11, 12, 13, 14. While, according to this embodiment, the above-mentioned tapered grooved pulleys 5, 6, 7, 8 are provided on the passageway of the conductor pairs to prevent them from being touched by each other, said pulleys 5, 6, 7, 8 may be replaced by similarly grooved flexible pipes. The support rods 11 to 14 are each fitted with a pair of pulleys 15, 16. The paired pulleys 15, 16 fitted to the support rods 11, 13 are operated by a drive source 35, while the paired pulleys 15, 16 fitted to the support rods 12, 14 are operated by another drive source 36. Four belts 17, 18, 19, 20 are each stretched across the paired pulleys 15, 16. Four groups of wire guides $21_1$-$21_4$, $22_1$-$22_4$, $23_1$-$23_4$ and $24_1$-$24_4$ are mounted on the four belts 17, 18, 19, 20 respectively. The wire guides of each group are arranged at a substantially equal horizontal interval to match the four grooves provided in each tapered pulley. The sixteen conductor pairs which have passed through the wire guides are all converged in a bundling die 26. The 16 conductor pairs thus bundled are wound with an insulation tape to finish a telecommunication cable 28. Two vertical position-setting devices 37 respectively consisting of two groups of the aforesaid upright parallel disposed arms 25*a*-25*c*-25*e*-25*g* and 25*b*-25*d*-25*f*-25*h* are provided above and below the passageway of the 16 conductor pairs respectively and between the bundling die 26 and the four groups of wire guides. The vertical movement of the selected ones of said two groups of upright arms defines the vertical positions of the desired ones of the 16 conductor pairs. Said vertical position-setting device 37 may consist of a mechanism effecting vertical positioning which is used with the table of an ordinary working machine. The same applies to the later described horizontal position-setting device. For convenience, the positions occupied by for example, four conductor pairs of each conductor unit in the cross sectional area of a telecommunication cable are designated as $\alpha$, $\beta$, $\gamma$, $\delta$. The conductor pairs of the four conductor units are initially in the normal order as illustrated in FIG. 2-(1), before their relative positions are interchanged. For convenience, the conductor pairs passing through the wire guides 21 to 24 are indicated as 1, 2, 3, 4,** those traveling through the wire guides $22_1$ to $22_4$ as *a, b, c, d,* those conducted through the wire guides $23_1$ to $23_4$ as A, B, C, D and those pulled through the wire guides $24_1$ to $24_4$ as I, II, III, IV. The arrows indicated in FIGS. 2-(1), 2-(2), 2-(3), 2-(4), 2-(5) show that the operation of the drive sources 35, 36 control the rotation of the paired pulleys 15, 16, namely, the horizontal movement of the belts 17, 18, 19, 20. The conductor pairs 1, a, A, I initially taking the positions shown in FIG. 2-(1) are collected in the $\alpha$ position of FIG. 3 by the action of the arms 25*a*, 25*b* of the vertical position-setting devices 37, after passing through the wire guides $21_1$, $22_1$, $23_1$, $24_1$. Similarly, the action of the arms 25*c*, 25*d* collects the conductor pairs 2, *b*, B, II in the $\beta$ position of FIG. 3 after they are carried through the wire guides $21_2$, $22_2$, $23_2$, $24_2$. The action of the arms *e, f* gathers the conductor pairs 3, *c*, C, III in the $\gamma$ position of FIG. 3 after they are conducted through the wire guides $21_3$, $22_3$, $23_3$, $24_3$. The action of the arms 25*g*, $25_h$ converges the conductor pairs 4, *d*, D, IV in the $\delta$ position of FIG. 3 after they are pulled through the wire guides $21_4$, $22_4$, $23_4$, $24_4$. The bundled condition of the conductor pairs shown in FIG. 3 is attained by the following sequential position-interchanging steps. Starting with the condition of FIG. 2-(1), the wire guides $21_1$ to $21_4$ for pulling the conductor pairs 1, 2, 3, 4, are shifted one pitch to the right of the belt 17. The wire guides $22_1$ to $22_4$ for conducting the conductor pairs *a, b, c, d* are moved two pitches in the left of the belt 18. The wire guides $23_1$ to $23_4$ for passing the conductor pairs A, B, C, D are displaced two pitches to the right of the belt 19. The wire guides $24_1$ to $24_4$ for guiding the conductor pairs I, II, III, IV are carried one pitch to the left of the belt 20. As the result, the respective conductor pairs take the positions indicated in FIG. 2-(2). Where, under this condition, the required ones of the arms 25*a* to 25*h* of the vertical position-setting devices 37 are operated, the conductor pairs constituting the conductor units places in the $\alpha$, $\beta$, $\gamma$, $\delta$, position are gathered as illustrated in FIG. 4 in the prescribed lengthwise section $l_2$ of a telecommunication cable. With respect to the succeeding lengthwise sections $l_3$, $l_4$, $l_5$, the conductor pairs included in the respective conductor units have their relative positions interchanged and vertically moved, if required, as shown in FIGS. 2-(3), 2-(4) and 2-(5) so as to decrease the "adjoining ratio." According to the above-mentioned embodiment of this invention associated with a telecommunication cable consisting of 16 conductor pairs, the conductor pairs *a, b, c, d,* and A, B, C, D are shifted two pitches on the corresponding belts, whereas the conductor pairs 1, 2, 3, 4 and I, II, III, IV are made to move one pitch.

Further according to said embodiment, the conductor pairs of each conductor unit whose number is defined by that of the wire guides provided were chosen to occupy four position $\alpha$, $\beta$, $\gamma$, $\delta$ in the cross sectional area of a telecommunication cable. However, each conductor pair may take any of eight positions $\alpha$, $\beta$, $\gamma$, $\delta$, $\epsilon$, $\zeta$, $\eta$, $\theta$ by having their relative positions interchanged by the sequential steps shown in FIGS. 5-(1) to 5-(9).

Said sequential steps of interchanging the relative positions of the conductor units are carried out in the arrow directions indicated in FIG. 5 as described in connection with FIGS. 2-(1) to 2-(5). While, in this case, the respective belts are moved stepwise one pitch corresponding to a distance between two adjacent wire guides, the conductor pairs travel two pitches on the corresponding belts so as to have their relative positions interchanged.

Figure 6:
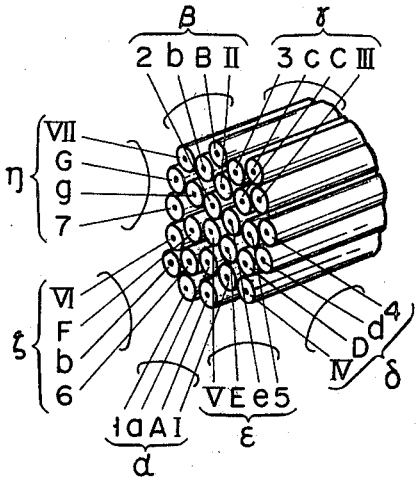
FIG. 6 is a fractional oblique view of bundled 28 conductor pairs included in the same number in, for example, seven conductor units constituting a telecommunication cable whose relative positions have been defined for each conductor unit.

Another embodiment of this invention in which a coaxiable telecommunication cable comprises seven conductor units each consisting of four fine conductor pairs, namely, contains 28 conductor pairs in all, as illustrated in FIGS. 6 and 7 can attain the intended object all the same. According to this embodiment, the wire guides are spaced 1.5 cm from each other and four conductor pairs constitute one conductor unit. Each of said conductor pairs may take any of seven positions $\alpha$, $\beta$, $\gamma$, $\delta$, $\epsilon$, $\zeta$, $\eta$ in the cross sectional area of the cable. The conductor pairs of each of said seven conductor units have their relative positions successively interchanged for each prescribed lengthwise section $l$ ($l$=1$m$) of the cable measuring 1 meter by the sequential steps shown in FIGS. 7-(1) to 7-(8). As previously described, the conductor pairs were chosen to take the positions $\alpha$ to $\delta$ or $\alpha$ to $\eta$. However, the positions occupied by the conductor pairs in the cross sectional area of the cable may be freely selected according to the action of the arms 25*a* to 25*h* of the vertical position-setting devices 37, as well as the shifting of the wire guides.

It has been experimentally proved that in the embodiment of FIGS. 6 and 7-(1) to 7-(8), the crosstalk characteristics of a telecommunication cable as a whole have been improved by at least 10 dB over the prior art type as seen from FIG. 8 showing the relationship between the undesirably increased "adjoining ratio" and the ratio of signal to far end crosstalk.

Figure 9:
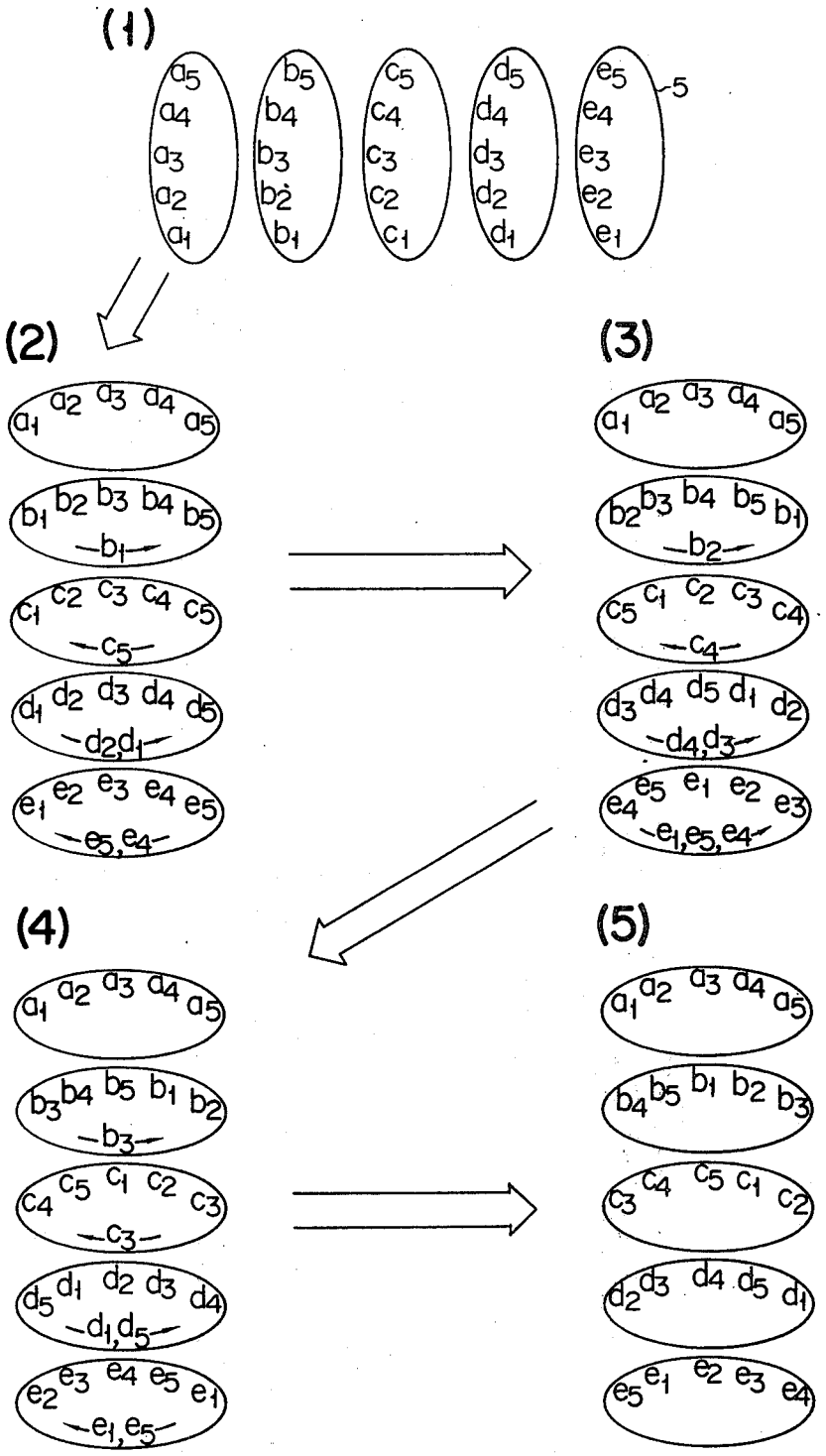
FIG. 9 shows the sequential steps by which twenty-five conductor pairs included in the same number in five conductor units constituting a telecommunication cable have their relative positions interchanged for each conductor unit from one prescribed lengthwise section of the cable to another according to still another embodiment of the invention.

There will now be described the embodiment of FIG. 9 in which a telecommunication cable comprises five conductor units each formed of five conductor pairs, namely, contains 25 conductor pairs. In this case, it is advised to divide the 25 conductor pairs into five groups as $a_1$ to $a_5$, $b_1$ to $b_5$, $c_1$ to $c_5$, $d_1$ to $d_5$ and $e_1$ to $e_5$, set every five conductive pairs in the cross sectional area 5 of the cable, successively interchange the relative positions of conductor pairs constituting the conductor units occupying the five positions $\alpha$, $\beta$, $\gamma$, $\delta$, $\epsilon$ through the prescribed lengthwise sections $l$-(1), $l$-(2), $l$-(3), $l$-(4), $l$-(5) in accordance with the sequential position-interchanging steps shown in FIGS. 9 ((1)-(5)) by moving the corresponding wire guides.

Figure 11:
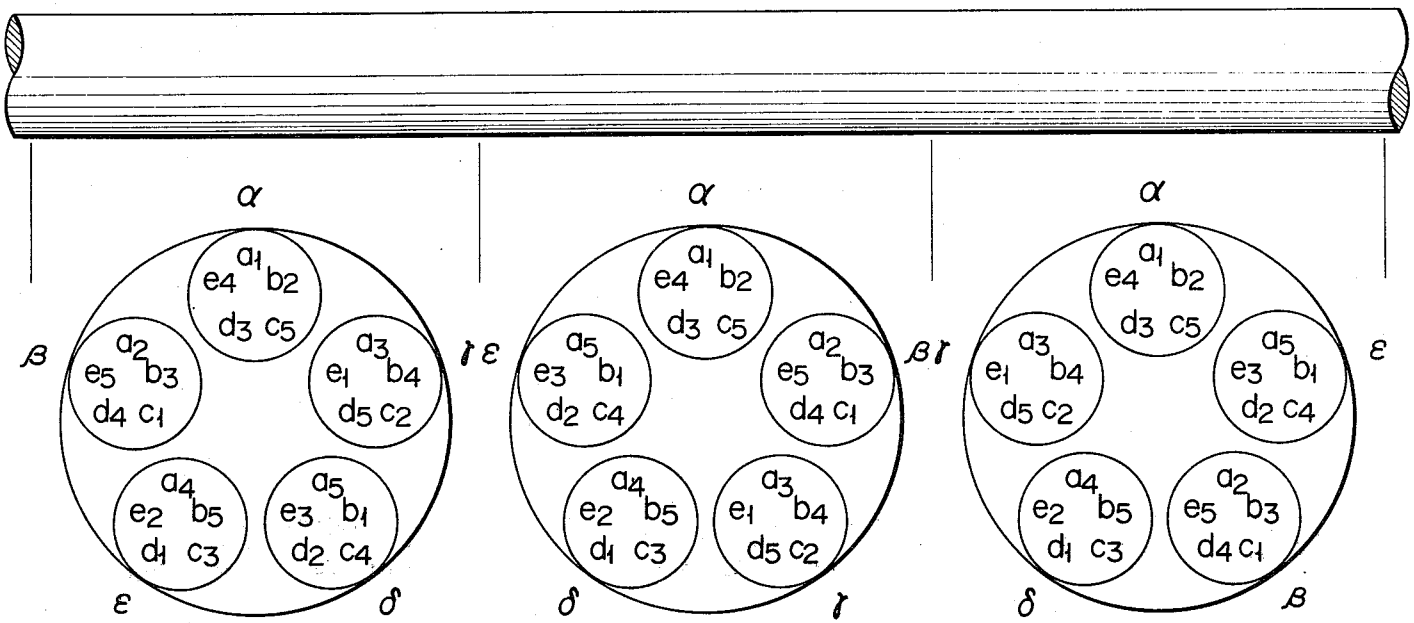
FIG. 11 illustrates the manner in which the 25 conductor pairs included in the same number in the five conductor units constituting a telecommunication cable shown in FIG. 9 have their relative positions interchanged three times for each unit in one prescribed lengthwise section of the cable.

The positions in the cross sectional area of a telecommunication cable which are indicated by the aforesaid designations $\alpha$, $\beta$, $\gamma$ . . . . are not permanently fixed, but may be freely interchanged. Where, therefore, the positions occupied by the conductor units each having a fixed conductor pair arrangement may be interchanged three times in, for example, a lengthwise section $l_3$ as illustrated in FIG. 11, then the required steps of interchanging the relative positions of conductor units can be carried out at a smaller frequency than in the prior art. This process offers a better advantage, because it effectively decreases the adjoining ratio of conductor pairs, thereby facilitating the manufacture of the cable. The frequency Ps at which the relative positions of conductor pairs are interchanged through the successive prescribed lengthwise sections of a telecommunication cable is generally expresed by the following equation:

$$Ps = M \times \sqrt{N}$$

where:

$M$ = a sufficient number of times the conductor units each having a fixed conductor pair arrangement have their relative positions interchanged in each major division of the cable to decrease the adjoining ratio of the conductor pairs constituting said conductor units $\sqrt{N}$ = a total number of conductor units $N$ = a number of conductive pairs.

Figure 12:
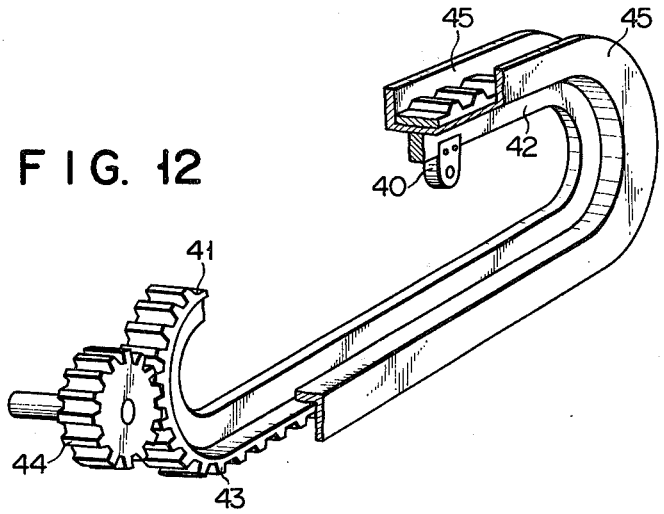
FIG. 12 is a schematic oblique view of the driving mechanism of a wire guide according to an embodiment of the invention.

There will now be described an embodiment of the apparatus for manufacturing a telecommunication cable according to this invention. FIG. 12 shows a mechanism for driving wire guides. For briefness, description refers to only one wire guide. A wire guide 40 is fixed to a projection 42 formed on one side of an endless belt 41. The other side of the endless belt 41 constitutes a rack 43. Engaged with the rack 43 is a pinion 44 for controlling the movement of the endless belt 41. The endless belt 41 may be prepared from flexible plastic material or formed of a metal chain. Where the endless belt 41 consists of plastic material, a pair of channels 45 are fitted to the belt 41 to support both edges thereof and prevent the belt 41 from being deformed during movement. The rack-pinion assembly causes the wire guide to be moved with the endless belt 41 under controlled condition.

Figure 13:
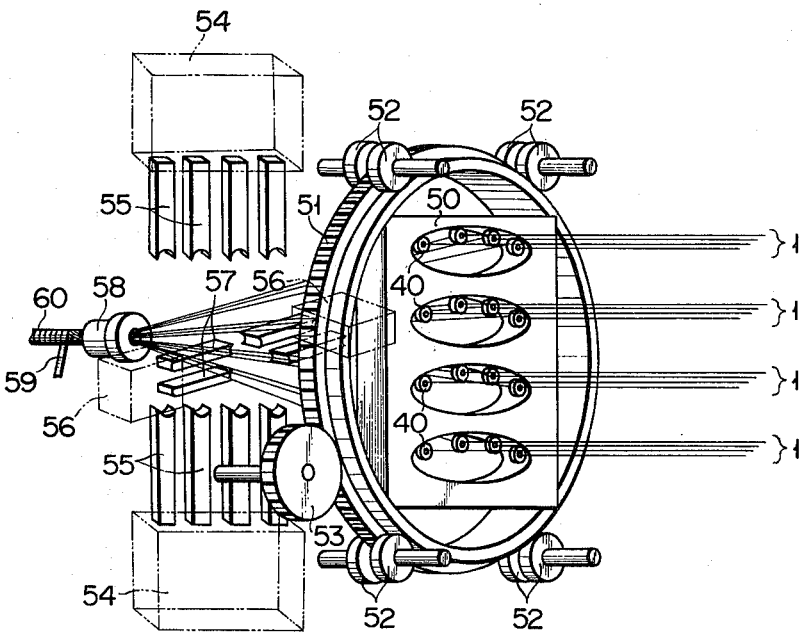
FIG. 13 is a schematic oblique view of an apparatus according to an embodiment of the invention for manufacturing a telecommunication cable.

There will now be described by reference to FIG. 13 an actual apparatus for manufacturing a telecommunication cable by bundling a plurality of conductor pairs by the proper movement of the wire guides. This apparatus does not use a plurality of belts as previously described but a single parallelepiped solid block 50 bored with four elliptic holes. Four wire guides for each conductor unit are equidistantly fitted to the inner wall of one longer circumferential portion of each horizontal elliptic hole. The parallelepiped solid block 50 is fixed inside of a rotary ring 51, which is driven by a drive roller 53 and further rotatably supported by four support roller assemblies equidistantly arranged on the outer periphery of said ring 51. The four conductor pairs of each conductor unit conducted through the corresponding wire guides 40 have their relative positions defined according to the placement of said conductor unit in the cross sectional area of a cable by the action of the arms 55 of two vertical position-setting devices 54 disposed above and below the passageway of the four conductor pairs respectively as well as by the action of the arms 57 of two horizontal position-setting devices 56 provided on both sides of said passageway. The sixteen conductor pairs constituting four conductor units whose relative positions have been set by the above-mentioned both groups 55, 57 of position-setting arms are all converged in a bundling die 58 and collectively wound with a tape 59 to finish a telecommunication cable 60. The control of the drive of the rotary ring 51, the selection of required arms from among two groups of arms 55 of the two vertical position-setting devices 54 and the selection of required arms from among two groups of arms 57 of the two horizontal position-setting devices 56 are all carried out so as to decrease the adjoining ratio of conductor pairs from one prescribed lengthwise section of the cable to another, thereby attaining the unification of electric properties of all the conductor pairs and the improvement of crosstalk characteristics of the cable 60 as a whole.

There will now be described the sequential steps of interchanging the relative positions of conductor pairs in constructing a telecommunication cable by the apparatus shown in FIG. 13. In the above-mentioned embodiment representing a telecommunication cable comprising 16 conductor pairs, every four conductor pairs constituting four conductor units pulled through the corresponding wire guides 40 supported on the inner walls of the four elliptic holes bored in the solid block 50 are designated as *a, b, c, d;* 1, 2, 3, 4; A, B, C, D; and I, II, III, IV as counted from above. Referring to FIG. 13, the rotary ring 51 is rotated 90° to the left in the first sequential step, causing the conductor pairs of the respective conductor units initially to take the positions indicated in FIG. 14 in a prescribed lengthwise section $l_1$ of a telecommunication cable. Thereafter, the arms 55 of the two upper and lower vertical position-setting devices 54 and the arms 57 of the two right and left horizontal position-setting devices 56 are operated to cause the conductor pairs distinguished by the above-mentioned designations to take the positions shown in the prescribed lengthwise section $l_1$ of FIG. 15 in the respective conductor units placed in the $\alpha$, $\beta$, $\gamma$, $\delta$ positions in the cross sectional area of a telecommunication cable.

Figure 14:
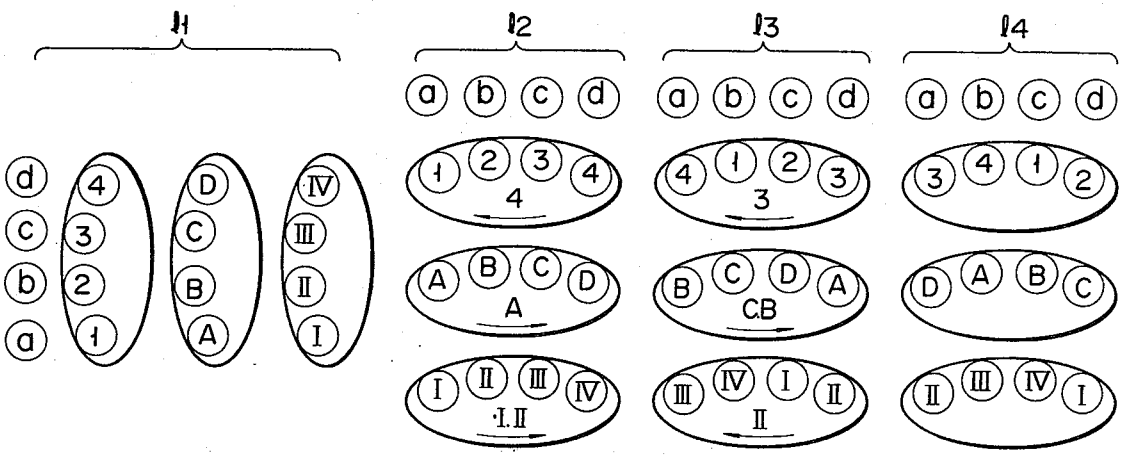
FIG. 14 sets forth the sequential steps by which the conductor pairs of a telecommunication cable manufactured by the apparatus of FIG. 13 have their relative positions interchanged for each conductor unit from one prescribed lengthwise section of the cable to another.

In the second sequential step, the rotary ring 51 is brought back to the original position, causing the conductor pairs to take the positions indicated in the lengthwise section $l_2$ of FIG. 14. Where, under this condition, the conductor pairs are collected for each conductor unit after selective operation of the arms 55, 57, then said conductor pairs of the respective conductor units present the arrangement shown in the lengthwise section $l_2$ of FIG. 15.

In the third sequential step relative to the following section $l_3$, the wire guides are shifted to move the conductor pairs 1, 2, 3 of the preceding section $l_2$ one pitch to the right, thereby causing the conductor pair 4 to be placed in the position previously occupied by the conductor pair 1. Next, the wire guides are driven to move the conductor pairs B, C, D one pitch to the left so as to bring the conductor pair A of the preceding section $l_2$ to the position previously taken by the conductor pair C. Further the wire guides are operated to shift the conductor pairs III, IV two pitches to the left, thereby causing the conductor pairs I, II to be placed in the positions previously occupied by the conductor pairs III, IV. The above-mentioned sequential steps provide the arrangement of conductor pairs shown in the section $l_3$ of FIG. 14.

Where, under this condition, the conductor pairs are gathered for each conductor unit after the selective operation of the arms 55, 57, then said conductor pairs indicate the arrangement shown in the section $l_3$ of FIG. 15 for the respective conductor units placed in the $\alpha$, $\beta$, $\gamma$, $\delta$ positions in the cross sectional area of the cable.

In the fourth sequential step associated with the succeeding section $l_4$, the wire guides are shifted through a prescribed pitch distance in the arrow directions shown in FIG. 14 from the position which provided the arrangement of the section $l_3$ of FIG. 14. The subsequent operation of the arms 55, 57 realizes the conductor pair arrangement of the respective conductor units placed in the $\alpha$, $\beta$, $\gamma$, $\delta$ positions, as illustrated in the section $l_4$ of FIG. 15.

Figure 16:
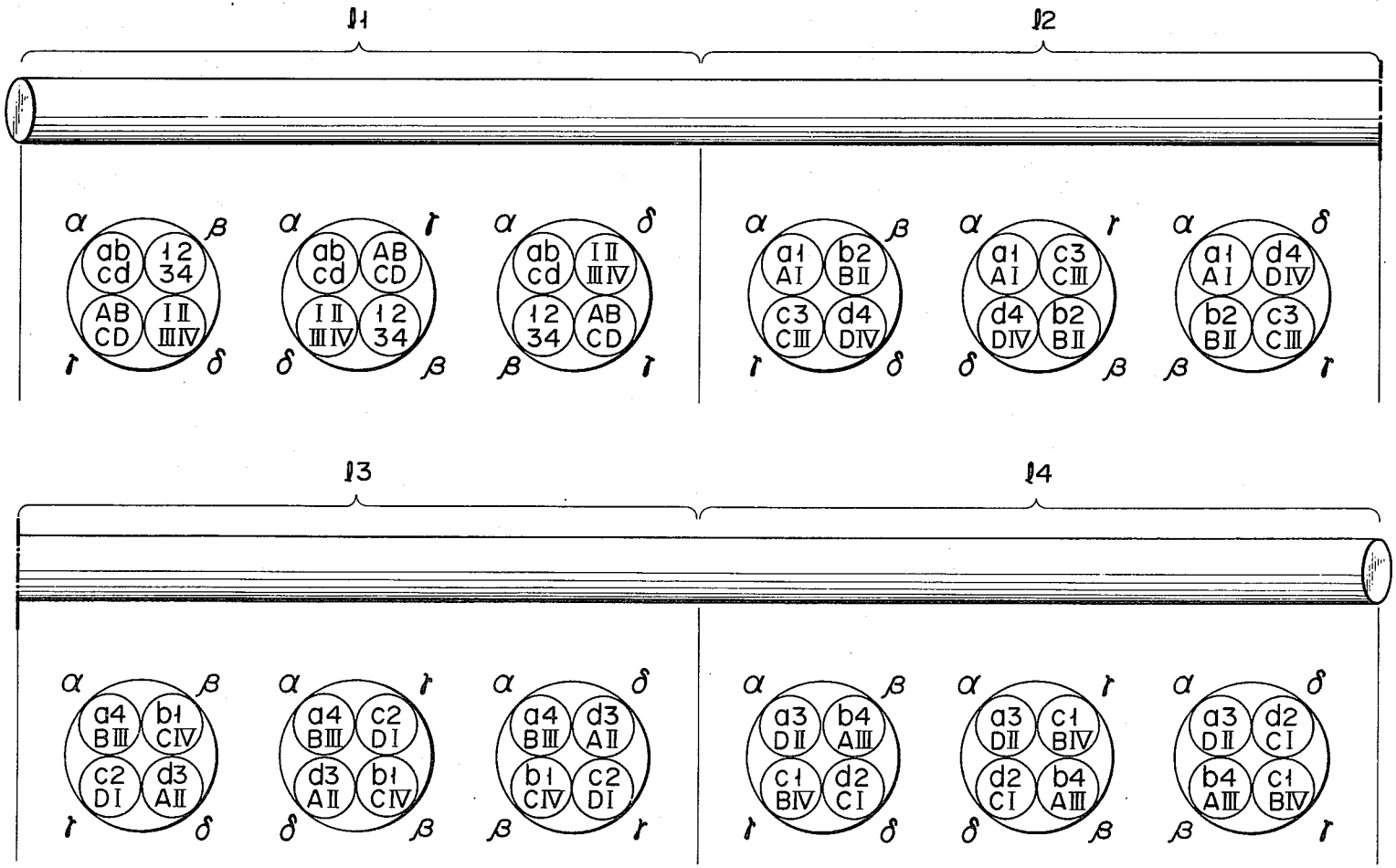
FIG. 16 indicates the manner in which the conductor pairs constituting the respective conductor units whose relative positions were previously interchanged through the prescribed lengthwise sections $l_1$ to $l_4$ of a telecommunication cable as shown in FIG. 15 have their relative positions interchanged three times for each conductor unit in each of said lengthwise sections $l_1$ to $l_4$.

FIG. 16 presents the sequential steps by which four conductor units each having a fixed conductor pair arrangement in any of the prescribed lengthwise sections $l_1$ to $l_4$ of the cable have their relative positions interchanged three times in said section, with said conductor pair arrangement of each conductor unit varied from one section to another.

What we claim is:

1. A telecommunication cable comprising:

a plurality of conductor units bundled together, each conductor unit occupying a prescribed position in the cross-section of the cable and each conductor unit including at least four conductor pairs; and a plurality of lengthwise adjacent continuously connected sections, the conductor pairs of the conductor units being systematically interchanged in position relative to other conductor pairs of its respective conductor unit at each of said adjacent sections and said conductor pairs being systematically interchanged between conductor units at selected ones of said adjacent sections, so that both the grouping of said conductor pairs and the positions of said conductor units are systematically changed along the length of the cable to decrease the length over which any two conductor pairs are immediately adjacent each other, thereby reducing crosstalk among the conductor pairs.

2. A telecommunication cable according to claim 1 comprising four conductor units, each conductor unit including four conductor pairs, said four conductor units being located in four prescribed positions in the cross-section of the cable.

3. A telecommunication cable according to claim 1 comprising seven conductor units, each conductor unit including seven conductor pairs, said seven conductor units being located in seven prescribed positions in the cross-section of the cable.

4. A telecommunication cable according to claim 1 comprising five conductor units, each conductor unit including five conductor pairs, said five conductor units being located in five prescribed positions in the cross-section of the cable.

5. A telecommunication cable according to claim 1 wherein at least one of said conductor pairs is systematically interchanged between two conductor units at each of said adjacent sections.

6. A telecommunication cable according to claim 1, wherein the conductor pairs have their relative positions interchanged from one prescribed lengthwise section of the cable to another at a frequency expressed by a formula:

$$Ps = M \times \sqrt{N}$$

where:

$Ps$ = number of times the relative positions of conductor pairs are interchanged from one prescribed lengthwise section of the cable to another $M$ = frequency of interchanging of the relative positions of conductor units themselves from one prescribed lengthwise section of the cable to another;

$N$ = number of conductive pairs and $\sqrt{N}$ = number of conductor units.

* * * * *